US005659845A

United States Patent [19]

Krist et al.

[11] Patent Number: 5,659,845

[45] Date of Patent: Aug. 19, 1997

[54] ACCOUNTING SYSTEM FOR USE WITH DOCUMENT PROCESSING SYSTEM

[75] Inventors: Peter M. Krist; Katherine E. Hayes, both of Rochester; James C. Strossman, North Rose, all of N.Y.

[73] Assignee: Xerox Corporation, Stamford, Conn.

[21] Appl. No.: 655,421

[22] Filed: May 30, 1996

[51] Int. Cl.[6] ..... G03G 21/02

[52] U.S. Cl. ..... 399/79; 377/14

[58] Field of Search ..... 399/79, 80, 83; 377/13–16

[56] References Cited

U.S. PATENT DOCUMENTS

| | | | |
|---|---|---|---|
| 4,206,346 | 6/1980 | Hirosawa et al. . | |
| 4,531,826 | 7/1985 | Stoughton et al. | 399/80 |
| 4,689,757 | 8/1987 | Downing et al. | 377/13 |
| 4,774,544 | 9/1988 | Tsuchiya et al. | 399/24 |
| 4,852,104 | 7/1989 | Finger | 377/16 X |
| 5,117,258 | 5/1992 | Iwata . | |
| 5,146,344 | 9/1992 | Bennett et al. | 358/296 |
| 5,299,026 | 3/1994 | Vincett et al. | 358/401 |
| 5,300,761 | 4/1994 | Kasahara et al. | 235/375 |
| 5,383,129 | 1/1995 | Farrell | 364/464.01 |
| 5,479,467 | 12/1995 | Katsumata | 377/15 X |

*Primary Examiner*—Robert Beatty

*Attorney, Agent, or Firm*—Gary B. Cohen

[57] ABSTRACT

There is provided an accounting system for a document processing system which executes one or more jobs with multiple document processing facilities. One of the jobs is identified by a unique identifier and has its origin in a document in a hardcopy or electronic form. A first portion of the one job is processed with a first one of the multiple document processing facilities, in accordance with a first set of control instructions, to result in a first accountable event characterized by a first set of one or more attribute values, and a second portion of the one job is processed with a second one of the multiple document processing facilities, in accordance with a second set of control instructions to result in a second accountable event characterized by a second set of one or more attribute values. The accounting system includes an account log for storing a first set of information and a second set of information, the first and second sets of information respectively including the first and second sets of one or more attribute values, and the first and second sets of information being associated with one another by reference to the unique identifier. The accounting further includes an account log manager, communicating with the first and second ones of the multiple document processing facilities, for receiving the first and second sets of information from the first and second ones of the multiple document processing facilities to store the first and second sets of information in the account log as a virtually integrated unit.

20 Claims, 6 Drawing Sheets

DESCRIPTION

Billable Event Supplier:

Request: Configure / Record

Event: Attribute(s) [Value(s)]

Miscellaneous Information:

FIG. 3

ACCOUNTING SYSTEM FOR USE WITH DOCUMENT PROCESSING SYSTEM

BACKGROUND AND MATERIAL DISCLOSURE STATEMENT

This invention relates generally to a document processing system and, more particularly, to an accounting system, for use with such document processing system, that receives a first information set and a second information set from multiple document processing facilities for storing the same as a virtually integrated unit.

Electronic reprographic machines or electronic printing systems may possess a wide range of system functions, including binding, scanning, stapling, stitching, shrink wrapping, etc. A print shop may use an electronic reprographic machine with robust functionality to meet the needs of customers who seek copies of "short run" jobs. Even though short run jobs may not require the setting of a master, they still may utilize a large range of functions and materials (e.g. paper and toner). Maintaining records of those functions employed and materials used is a simple matter for electronic reprographic machines with digital capability and mass memory, e.g. a disk storage device.

In one example, a record of the materials used for each short run job (hereinafter referred to simply as "job") is maintained in a dedicated account for a customer. In one conventional approach, such as that disclosed in U.S. Pat. No. 5,117,258 to Iwata (Issued: May 26, 1992), each customer is mapped to a given paper type set with a plurality of paper types. Additionally, each paper type in the set is provided with a fixed rate. As the job for a given customer is executed, the number of sheets used for each paper type is counted and the number of sheets used for each paper type is tabulated. The tabulated sums are then multiplied with their respective rates so that a billable amount for the paper types used can be determined. The billable amounts are then summed to provide a total cost for paper used.

The approach of Iwata appears to be inefficient, with respect to memory usage because, as shown in FIG. 10 of Iwata, the set of paper types is set uniformly for each customer. It will be appreciated that the needs of the customers changes over time and the demand of even a single customer may vary over time. This apparent problem of setting uniform account size for each customer appears to be solved by U.S. Pat. No. 5,146,344 to Bennett (Issued: Sep. 8, 1992) in which a machine administrator can create a new account and specify a subset of system functions, from a set of system functions, to be used in the new account. In particular, it is believed that the set of system functions is "hard-coded" into the associated electronic reprographic machine in the form of a predesignated set of billing meters and the system administrator can specify which of the billing meters in the hard-coded set are to be used in setting up the new account.

While this approach disclosed by Bennett is certainly more flexible than the approach provided by Iwata, the Bennett approach is not believed to provide a maximum degree of flexibility in either accommodating for new billing meters or providing for the deletion of preexisting billing meters. That is, for the situation in which billing meters are hard-coded in the host electronic reprographic machine, it is impossible to add or subtract from the meter set without writing code for the machine operating system and recompiling the operating system in order to implement such new code. It would be desirable to allow for a situation in which a user can freely add a new billable meter to or subtract a billable meter from the billable meter set without recompiling the operating system of the reprographic machine.

Additionally, the account setup disclosed by Bennett is believed to be inflexible in that an account is set up in terms of customers. In particular, a customer may wish to use the host electronic reprographic machine to print multiple jobs over time. In one example, a first print set of a job may be executed on one day and a second print set of a job may be executed on a second day. Moreover, the user may wish to be billed separately for each of the first and second jobs. The accounting system of Bennett does not appear to provide the flexibility to maintain a separateness between the first and second jobs in a single account. This is because accounting is performed on a customer rather than a job basis. It would be desirable to provide an accounting system that maintains a record of each instance of a job's printing so that a detailed record of the job, with respect to functions performed on the job and materials employed in printing the job can be maintained over an extended period.

SUMMARY OF THE INVENTION

In accordance with the present invention there is provided an accounting system for a document processing system which executes one or more jobs with multiple document processing facilities. One of the jobs is identified by a unique identifier and has its origin in a document in a hardcopy or electronic form. A first portion of the one job is processed with a first one of the multiple document processing facilities, in accordance with a first set of control instructions, to result in a first accountable event characterized by a first set of one or more attribute values, and a second portion of the one job is processed with a second one of the multiple document processing facilities, in accordance with a second set of control instructions to result in a second accountable event characterized by a second set of one or more attribute values. The accounting system includes: an account log for storing a first set of information and a second set of information, the first and second sets of information respectively including the first and second sets of one or more attribute values, and the first and second sets of information being associated with one another by reference to the unique identifier; and an account log manager, communicating with the first and second ones of the multiple document processing facilities, for receiving the first and second sets of information from the first and second ones of the multiple document processing facilities to store the first and second sets of information in the account log as a virtually integrated unit.

BRIEF DESCRIPTION OF THE DRAWINGS

FIG. 3 is a schematic view of an electronic description used in conjunction with the accounting system of FIGS. 1 and 2;

DESCRIPTION OF ONE OR MORE PREFERRED EMBODIMENTS

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 6:
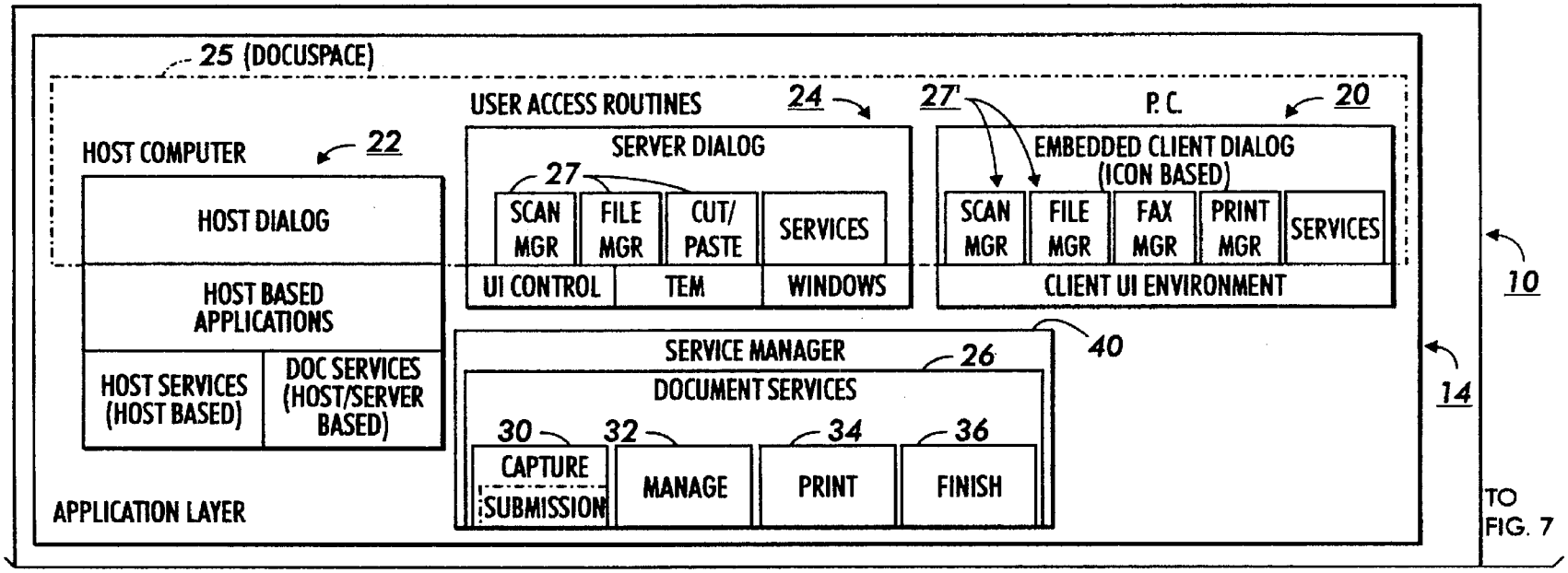
FIGS. 6 and 7 represent a schematic block diagram of the document services architecture in which subsystems associated with various layers are shown.
Figure 7:
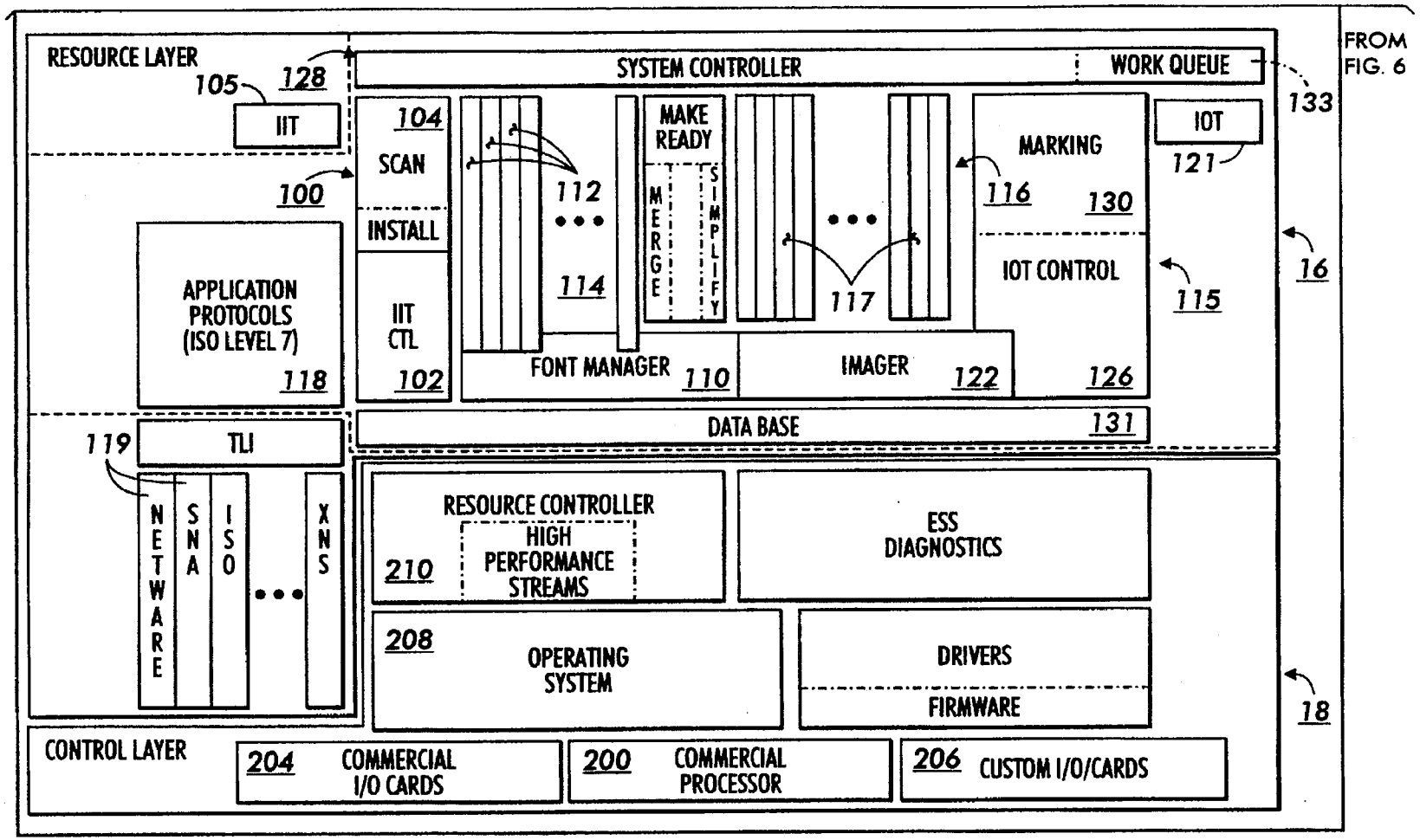

Referring generally to FIGS. 6 and 7 of the drawings, there is shown the document services architecture 10 of the present invention. Document services architecture 10 is a layered architecture in which the functions performed are grouped into vertically ordered strati, referred to herein as layers.

Document services architecture 10 has three principal layers; namely, an applications layer 14, a resource layer 16, and a control layer 18. Referring specifically to FIG. 6, applications layer 14 enables access to a defined set of document services from either a remote workstation such as a Personal Computer (PC) 20 or host computer 22, or user access routines (Dialog) 24 resident with the architecture 10. Layer 14 has a document services section 26 which cooperates with the modules and facilities of resource layer 16 to provide the document services offered by the architecture. Document services section 26 includes capture service 30, management service 32, printing service 34, and finishing service 36. Layer 14 additionally incorporates an overriding service manager 40 that coordinates and controls access to and collaboration between the individual document services provided by service section 26.

Resident user access routines Server (Dialog) 24 provide for interaction with the document services 26 through a defined set of UI descriptions 27 and operation paradigms (services). These UI descriptions 27 include scan manager, file manager, print manager, make ready selections such as cut and paste, and other services as described more fully in U.S. Pat. No. 5,493,634 to Bonk et al., the disclosure of which is incorporated herein by reference. Remote workstations such as PC 20 would also enable access to the aforementioned services via similar UI descriptions 27' when programming work input. This set of UI descriptions and paradigms provide a consistent and spatially independent document management programming and usage model document environment (DocuSpace) 25 that is supported by the rest of the architecture.

Resource layer 16 performs the work described to it by document services section 26 of applications layer 14, and for this purpose has a collected set of software modules and facilities which are capable of being reused, combined, and distributed to provide a variety of services and products.

Resource layer 16 (FIG. 7) consists of three principal sections: a system controller 128; facilities 100, 116, 119 sequenced by the system controller to carry out the document services called for (i.e., capture 30, management 32, printing 34, finishing 36); and a data base 131 shared by the facilities. Database 131 contains the shared information upon which facilities rely. Further details regarding the structure and operation of a system state controller, suitable for use in with the preferred embodiment is provided in U.S. Pat. No. 5,170,340 to Prokop et al., the disclosure of which patent is incorporated herein by reference.

For capture service 30 of application layer 14 (FIG. 6), the facilities in resource layer 16 (FIG. 7) comprise an image input facility 100, data stream section 116, and application protocols 118. Image input facility has IIT controller 102 and Scan manager 104. IIT controller 102 is to control an attached or remote document scanner 105, and scan manager 104 to capture work in the form of raster (bitmap) image descriptions or documents, or operating instructions in the form of job programming. A data stream section 116 provides various Page Description Language (PDL) and data stream interpreters 117 for a selection of PDL and data stream such as Postcript TM, Interpress, Laser Conditioned Data Stream (LCDS), Xerox TM Encoding Sequence (XES TM), etc. that are available from the input source data description such as coming from PC 20 or host computer 22. The data stream section 116 captures work in the form of electronic documents, which, in turn, are logical sequences of page descriptions and associated structure information, or operating instructions, in the form of printing instructions and/or finishing instructions.

Application protocols 118 are standard communication applications appropriate to a document service such as printing, filing, network, name dereferencing, etc. that are available in a variety of communication suites such as Xerox TM Network Services (XNS TM), International Standards Organization (ISO), etc. The transport protocol stacks 119 have protocol layers 1–6 that represent basic mechanisms for moving data between computing or communicating systems for the variety of communication suites. The architecture provides for a logical separation and automated binding between the Application protocols 118 of resource layer 16 and transport protocol 119 stacks of control layer 18. This allows arbitrary routing and mix and match of the applications to the transport stacks for the various communication suites.

For printing services 34 of application layer 14, the facilities provided in layer 16 comprise a font selection library 112, make ready section 114, and imager section 122. Font selection library 112 provides interpreters for various font formats such as FIS, Type I, F3, etc., and a font manager 110 that allows fonts in any format to be used interchangeably. Make ready section 114 supports pre-press and system xerographic operations and provides various service selections and options such as signatures, merge, cut and paste, etc., as noted in the aforecited Holt application.

Imager section 122 performs the necessary manipulation of image or page descriptions obtained via the capture service 30 of layer 14, combining the page descriptions with the data obtained from the font manager 110 or the environment (database) 131 to produce the final form data suitable for use by the Make ready section 114, or suitable for use by Image Output facility 115, or suitable for transmittal to and use directly by an Image Output Terminal (IOT) 121, or suitable for exporting to another system. Having a single shared Imager section 122 that is logically separate from the data stream section 116 allows for consistent imaging across the PDL and data stream interpreters 117, across various Image Output Terminals (IOT) 121 and between systems. A single shared imager 122 also facilitates integration of new interpreters 117 and allows for intermix of PDL and data streams within a document (compound document).

For finishing service 36, the image output facility 115 consists of the IOT controller 126 and marker 130. The former is for controlling the attached or remote Image Output Terminal (IOT) 121, the latter for producing the prints (documents) programmed.

The Image Output Terminal (IOT) 121 may be any suitable marking device such as a laser printer, ink jet printer, etc. The IOT 121 may also include finishing facilities such as sorting, stapling, binding, signature etc., which are also accessed/managed by the Image Output facility 115, on behalf of the finishing service 36 of document services section 26.

For management service 32 of application layer 14, the facilities in the resource layer 16 comprise the system controller 128, applications protocols 118, and font manger 110. System controller 128 provides access to and management of most system resources and database objects directly, while application protocols 118 provides remote access to the management service from either a PC 20 or host computer 22 via standard protocol mechanisms. Font manager 110 provide access to and management of the systems fonts.

Control layer 18 provides a virtual machine for server platforms as described in the above-mentioned Prokop patent, using standard commercial processor platforms 200 and standard and/or custom I/O cards 204, 206 for processing options. An industry standard operating system 208 such as UNIX is used with special custom supplied extensions to enable real time and multi-processing. Resource controller 210 of layer 18 coordinates bandwidth and resource access between the independent facilities.

System controller 128 of resource layer 16 coordinates operation of the facilities in resource layer 16 to accomplish the service called for, to enable concurrent operation, and to manage the productivity of the system through scheduling of the various facilities in layer 16 in cooperation with a resource controller 210 in control layer 18. Controller 128 controls facility resource management, job management, and the sequencing of job steps, the latter by scheduling the job steps in the work queues 133 of layer 16 associated with the particular facility used.

In the case where an operator decides to scan and print a document, system controller 128 creates a new job as described to it by applications layer 14 mediating with the operator via a remote workstation such as PC 20 or host computer 22, or through user access routines (Dialogs) 24. System controller 128 creates a plan for the job, specifying the various facility sequencing required to carry out the job. A set of priorities for the resources such as I/O bandwidth, physical memory, etc. is planned. To execute the plan, system controller 128 places work requests, representing the job steps, in the work queues 133 of the facilities required to perform the job. When a facility becomes idle, the facility accesses the work queue for that facility and selects the next work request to execute. If necessary due to priorities, control layer 18 redistributes the resources.

System controller 128 formulates a plan for each job similar to an assembly line. In executing the plan, controller 128 places the work requests in the appropriate work queues 133 for the facilities that will perform the work. Each facility draws the work requests from the work queue of the facility, accesses the appropriate database 131, and performs the appropriate operations. When completed, the facility places the results in the appropriate database and notifies system controller 128 that the work is completed.

System controller 128 exercises both general resource control and specific control over the work items by manipulating the work queues. For example, controller 128 may prohibit a facility from taking items from the facility's work queue, thereby freeing resources that would be used by that facility for use by other facilities.

Once a facility has work in the facility's work queue, operating system 208 examines its priorities to decide which facility's work to execute at any given moment. As the job progresses, controller 128 may modify the relative priorities of the facility's work. In the event controller 128 does this, controller 128 notifies resource controller 210 which then parcels out the needed resources accordingly.

In one example, scan section 100 places image data obtained from scanning in the database 131 and notifies the system controller 128 that scanning is completed. Controller 128 then places a print work item in the print facility's work queue, and the print facility (i.e., marker 130) generates the print output using the scanned in image data from database 131.

Capture service 30 and make ready service 114 are accessed directly through resident user access routines (Dialog) 24. PC 20 and host computer 22 access are not provided nor is selection of print and finishing services 34, 36 respectively. In this embodiment, document scanner 105 serves to capture the work while make ready section 114 supports the necessary pre-press and system xerographic operations.

The architecture is well suited for use as a network printing service that is accessed either remotely from host 22 or directly through resident user access routines 24.

Figure 1:
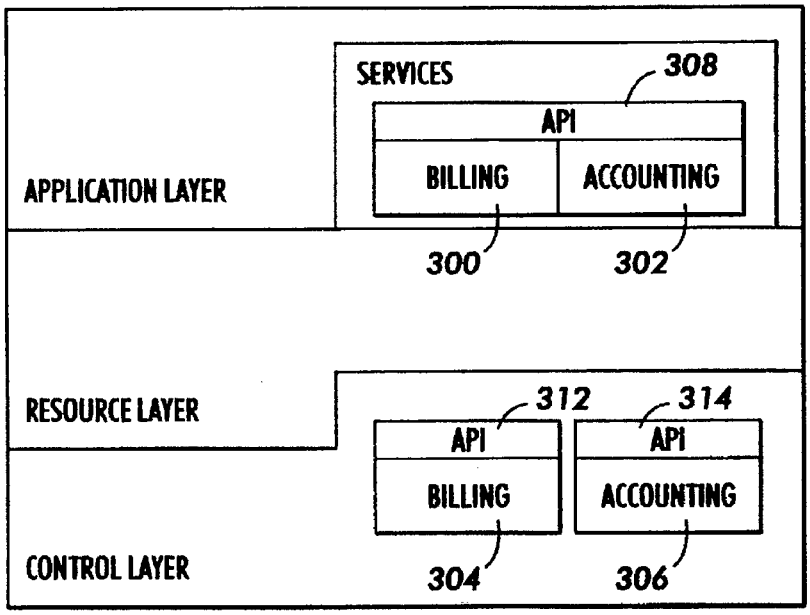
FIG. 1 is a schematic block diagram of a layered document services architecture including systems for providing billing and accounting services for a job upon which selected functions are performed.

Referring to FIG. 1, the architecture of FIGS. 6 and 7 is preferably provided with big and accounting functionality. In the illustrated embodiment of FIG. 1, a billing input subsystem 300 and an accounting input subsystem 302 are provided in the Services System of the Application Layer 14 so that a user can communicate with the billing application 304 and the accounting application 306, both of which billing and accounting applications are preferably disposed in the Control Layer. In practice, a user communicates with the subsystems 300 and 302 by way of interface 308, the interface 308 comprising, in one example, a suitable application programming interface ("API"). It will be appreciated by those skilled in the art that while a single API is shown for access to the subsystems 300, 302, a dedicated API could be provided for each of the subsystems 300 and 302. Use of one API for subsystem 300 and another API for subsystem 302 provides certain advantageous results, e.g. with dedicated APIs, one of the two APIs can be deleted without deleting the other API. The user and various event generators communicate with the applications 304 and 306 by way of respective interfaces 312 and 314. As will appear, the billing and accounting applications process information received from the Application and Resource Layers.

Figure 2:
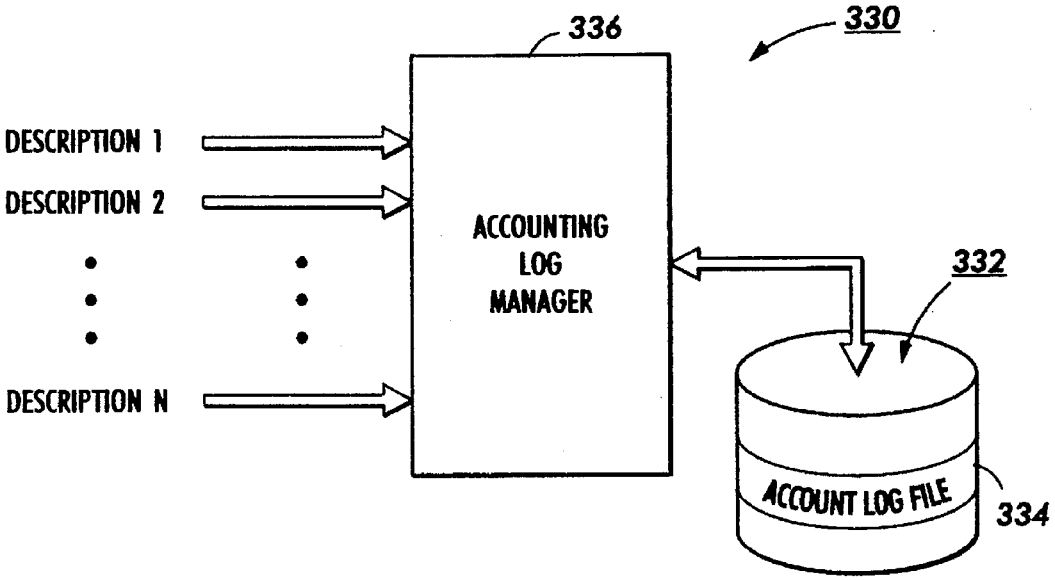
FIG. 2 is a block diagram of an accounting system embodying, in part, the present invention.

The structure of an accounting system is designated, in FIG. 2, with the numeral 330. It will be appreciated that much of the system 330 is implemented by way of accounting application 306 (FIG. 1). The system 330 includes a block of mass memory 332 which includes a configurable account log file 334. Descriptions 1, 2, . . . N, as discussed in further detail below, are provided by, among other sources, various subsystems of the resource layer 16, which resources may be distributed across local and/or wide area network(s). As will appear from the discussion below, a request associated with each description is executed with an accounting log manager 336.

Referring to FIGS. 3 and 7, each time a selected subsystem performs a function relative to a given document, the manager or controller associated with the selected subsystem generates an electronic description of the function, shown in FIG. 3. In the electronic description, which for ease of discussion is shown as a printed sheet, the subsystem which is responsible for performing an accountable function is referred to as the "billable event supplier". In practice, a billable event supplier provides information, referred to in FIG. 3 as a "request" for configuring the accounting system, in accordance with the information provided by way of "event" and/or "miscellaneous information, or entering/recording account information in an account, along with a suitable job indicator, to reflect the extent to which consumables or services are employed by a system user. As should be recognized, the job indicator can either be provided by way of a separate entry in the description or as miscellaneous information.

Figure 4:
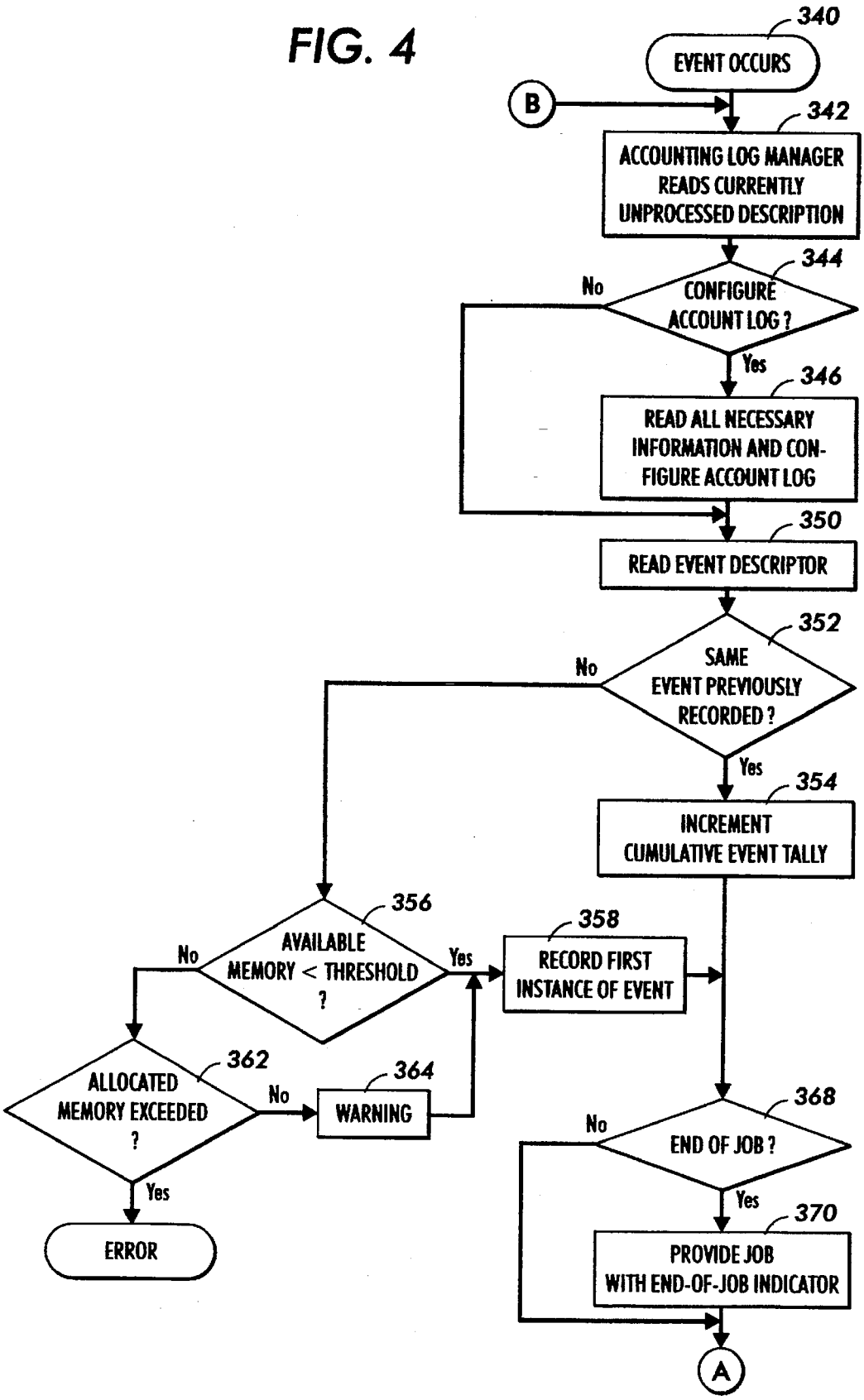
FIGS. 4 and 5 comprise a flow diagram demonstrating operability of the accounting system of FIGS. 1 and 2.
Figure 5:
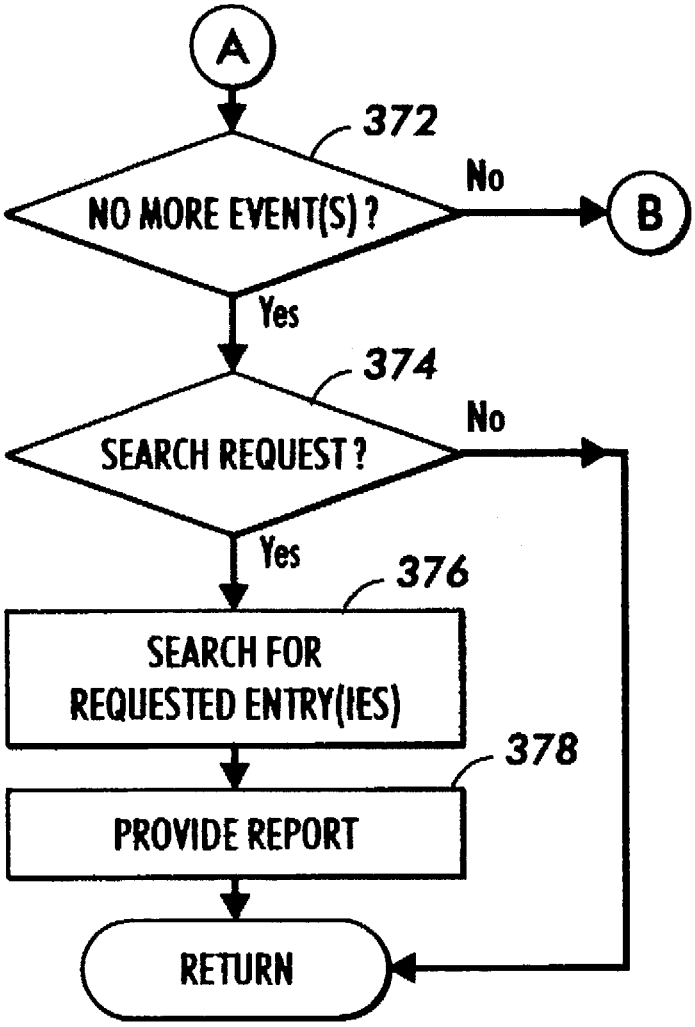

A comprehensive understanding of the functionality of the accounting system of FIGS. 1–3 can be obtained by reference to the flow diagram of FIGS. 4 and 5. In particular, an event, such as the scanning of a hardcopy page or the imaging of image data onto a substrate at step 340. In turn, the billable event supplier generates a description (such as shown in FIG. 3) and sends it to the accounting log manager 336 (FIG. 2). In response to reading the description (step 342), the accounting log manager determines whether the description calls for configuration of the account log (step 344) or the accumulation of account information. In the illustrated embodiment of FIG. 4, it will be assumed that the initial answer to the query of step 344 is in the positive and that the account log file requires configuring. It should be appreciated that configuring of the file is not required on a regular basis. Nonetheless, as will appear, reconfiguring of the may be required to accommodate for system demands.

Assuming that configuring is required, information for facilitating configuration of the account log is read,at step 346, by the accounting log manager. In the preferred embodiment, such information, which is provided by way of the description (FIG. 3), provides direction as to memory allocation and whether the accounting system is to be enabled or disabled. As should be appreciated, flexibility in system operation is increased when the accounting system can be "taken off line". Additionally, the configuration information, in one example, includes a path to the account log.

After performing all of the requested configuration operations, the accounting log manager 336 reads the event descriptor of the description (step 350) and determines, by way of step 352, whether the event described by such descriptor has already been recorded in the account log file 334 (FIG. 2). Using step 352, it is determined whether a record of a first instance of an event is to be formed or whether a preexisting record is to be incremented for indicating a cumulative tally.

Assuming that the event represents an event that is cumulative for the job currently in process, then the fact that the event has occurred multiple times for the same job is reflected in a cumulative tally (step 354). It will be appreciated that a cumulative value may be received from a billable event supplier in which case the need to increment or accumulate at the accounting manager, for a given event type, may be unnecessary. Even within a given entry of the configurable account log, it may be preferable to accumulate certain information (e.g. add to stock count) while replacing other information (e.g. replacing state information).

To comprehend the meaning of an accountable event, the following example should be instructive. In one instance, a particular type of toner A is imaged on a given stock B at a resolution C. This instance of imaging may be viewed as the event A, B and C for purposes of accounting. When this instance of imaging is first encountered, a record of A, B and C, subject to the constraints of steps 356, 358, 360 and 362, is made in the account log file and labeled with the provided job identifier. In turn, when another event descriptor indicates that the same A, B and C event has occurred again for the job currently being processed, the record of A, B and C is incremented to provide a cumulative event tally. In one example, a job identifier may be unique with respect to each instance for processing of a corresponding job, e.g. a first job identifier may reflect the processing of a job during one time interval while a second job identifier may reflect the processing of the same job during another time interval.

Assuming that the event represents an event that is occurring for the first time, a determination is made, at step 356, as to whether memory, made available through the allocation in step 346, has been used beyond a preset threshold (e.g. 80% of available memory). If the threshold has not been exceeded, then a record of the first instance of the event is recorded via step 358. On the other hand, if the threshold has been exceeded, then a determination is made, at step 360, as to whether all of the allocated memory has been consumed. If all of the allocated memory has been consumed, then an error routine is initiated -and more memory space may be allocated to the accounting system—other wise, a warning is provided (step 362) and the process executes step 358.

Assuming that the process proceeds through step 354 or step 358, it is determined, at step 368, whether the accounting for an instance of a job has been completed. If the end of a job instance has been reached, then, at step 370, an end-of-job indicator is stored by the accounting log manager 336 (FIG. 2); otherwise a check is performed as step 372 (FIG. 5) to determine if any more events have been received by the accounting log manager. The provision of end-of-job indicators is advantageous to the approach of the preferred embodiment in that accounting events are grouped in terms of a job occurrence. In other words, the end-of-job indicator provides information about when the processing of a job (instance) is completed. It follows that the accounting system could also be used to collect information regarding when the processing of a job commenced. In this manner, after a job is processed, a user, through use of beginning-of-job/end-of-job indicators can determine the times corresponding with the processing of a job instance. As will be appreciated, a given job original or master may be printed at various times during a given time interval (e.g. a month) and it may be useful or even necessary to gather information about the number of instances in which the job has been processed during such given time interval.

Referring again to step 372 (FIG. 5), if another event is to be reviewed by the accounting log manager, then the process loops back to step 342 (FIG. 4) to read another description. Assuming, however, that no events are pending, the accounting log manager determines, via step 374, whether a search request is pending. A search request comprises a request from a system user to obtain all of the entries for the given instance or instances of an executed job. It will be recognized that, preferably, the accounting log manager would not consider giving out such information without obtaining some sort of suitable security clearance. Under the appropriate conditions, the accounting log manager searches for entries for one or more instances of a given job based on the information provided by a user, such as security indicator, job identifier and time interval over which the search is to be performed. With this information in hand, the accounting log manager performs the search (step 376) and provides a report (step 378) that includes all of the requested entries for the given job. From the discussion above, it will be appreciated that many of the entries will be grouped together in one or more cumulative records thus making the report, at least in some instances, relatively brief in length.

In brief, the above-described accounting system provides an open interface for any facility to report accounting information specific to its functionality. This is accomplished through mechanisms, such as common dictionary utilities (found in Xerox' DocuSP (Ver. 1.0)) or other forms of name-values pairs. Received accounting information is queued and processed as received by an update component which appends the information to a persistent storage area. It should be appreciated that the present accounting log system is designed to serve an unlimited number of facilities across LANs and WANs. Moreover, the identifiers from such facilities would, at least in one example, reflect uniquely the origin of a given job.

Numerous features of the above-described embodiment(s) will be appreciated by those skilled the art.

First, the above-described accounting system corresponds with a distributed model of document processing which optimizes functionality with respect to multiple users and one or more networks. In particular, the accounting job manager can serve multiple clients in a local or wide area network. Moreover, due to the distributed nature of the accounting system, it can receive entries from many different users as well as provide information to many different requesters.

In a similar consideration, the accounting system decouples the accounting log from a typical database log. Persistency requirements for accounting information differs from that of job database information. This provides flexibility to a customer in managing the system. Facilities can report directly to the log. Other components can be written to retrieve data from the job database or other databases at an appropriate time to update the account log.

Second, the extensive configurability of the accounting system optimizes functionality of the document processing system as a whole. In one example, appropriate memory allocation insures that the accounting system will not unduly draw on the memory resources of the document processing system. In yet another example, disabling of current operation of the accounting system can be achieved without burdening future operation of the same. In particular, the accounting system allows for disablement at, among other places, a job portion boundary so that accounting for the interrupted job can be resumed readily at a later time.

Third, memory usage is optimized within the accounting system. In particular, records of events are maintained on a cumulative basis so that no more memory is employed in the account log file than is absolutely necessary. In one example, multiple instances of events are stored in one rather than multiple records.

Finally, the specifics of job processing over extended time intervals are reported with greater detail. For example, if a job is held and resumed several times, the quantities printed are reported for each interval.

Postcript is a Trademark of Adobe Corporation.

Xerox and all Xerox Products referred to herein are Trademarks of Xerox Corporation.

UNIX is a Trademark of AT&T Bell Laboratories.

We claim:

1. In a document processing system for executing one or more jobs with multiple document processing facilities, one of the jobs being identified by a unique identifier and having its origin in a document in a hardcopy or electronic form, a first portion of the one job being processed with a first one of the multiple document processing facilities, in accordance with a first set of control instructions, to result in a first accountable event characterized by a first set of one or more attribute values, and a second portion of the one job being processed with a second one of the multiple document processing facilities, in accordance with a second set of control instructions to result in a second accountable event characterized by a second set of one or more attribute values, an accounting system for maintaining respective accounts for the one or more jobs, comprising:

an account log for storing a first set of information and a second set of information, the first and second sets of information respectively including the first and second sets of one or more attribute values, and the first and second sets of information being associated with one another by reference to the unique identifier; and an account log manager, communicating with the first and second ones of the multiple document processing facilities, for receiving the first and second sets of information from the first and second ones of the multiple document processing facilities to store the first and second sets of information in the account log as a virtually integrated unit.

2. The accounting system of claim 1, wherein:

the account log manager receives a third set of information corresponding with the first set of one or more attributes; and the account log manager causes the first and third sets of information to be combined to provide a cumulative value reflecting a number of instances in which the first set of one or more attributes has been received at said accounting system.

3. The accounting system of claim 1, wherein:

the account log manager receives a third set of information corresponding with the first set of one or more attributes; and the account log manager causes at least a portion of the first set of information to be replaced by at least a portion of the third set of information.

4. The accounting system of claim 1, wherein the multiple document processing facilities are located in a single apparatus.

5. The accounting system of claim 1, in which said account log and said account log manager are located in a server, wherein at least one of the multiple document processing facilities communicates with the server by way of a network.

6. The accounting system of claim 1, in which said account log comprises a portion of configurable memory, wherein the configurable memory is configured in response to input from a user to said account log manager.

7. The accounting system of claim 1, wherein said account log is switchable between an enabled state and a disabled state so that storage of information sets is permitted in the enabled state and prohibited in the disabled state.

8. The accounting system of claim 7, in which a job is being received by said account log and said account log is in the enabled state, wherein disabling of said account log is delayed until execution of a portion of the job is completed.

9. The accounting system of claim 1, in which a portion of a job is executed by the document processing system, wherein an indication that the portion of the job has been executed is stored by said account log manger.

10. The accounting system of claim 1, wherein a third set of information and a fourth set of information, respectively including a third set of one or more attribute values and a fourth set of one or more attribute values are stored in said account log, the third and fourth sets of information being associated with one another by reference to a second unique identifier; and the third and fourth sets of information are received by said account log manager from third and fourth ones of the multiple document processing facilities to store the third and fourth sets of information in the account log as a second virtually integrated unit.

11. The accounting system of claim 1, wherein the unique identifier is equivalent to the second unique identifier.

12. The accounting system of claim 1, wherein the first and second sets of information are multiplied by one or more billing rates to provide a cost value for representing the cost associated with executing one or more jobs in the document processing system.

13. In a document processing system for executing one or more jobs with multiple document processing facilities, one of the jobs being identified by a unique identifier and having its origin in a document in a hardcopy or electronic form, a first portion of the one job being processed with a first one of the multiple document processing facilities, in accordance with a first set of control instructions, to result in a first accountable event characterized by a first set of one or more attribute values, and a second portion of the one job being processed with a second one of the multiple document processing facilities, in accordance with a second set of control instructions to result in a second accountable event characterized by a second set of one or more attribute values, an accounting method for maintaining respective accounts for the one or more jobs, comprising:

storing a first set of information and a second set of information in an account log, the first and second sets of information respectively including the first and second sets of one or more attribute values, and the first and second sets of information being associated with one another by reference to the unique identifier; and using an account log manager to store the first and second sets of information in the account log as a virtually integrated unit.

14. The method of claim 13, further comprising combining a third set of information, corresponding with one of the first and second sets of one or more attributes, with one of the first and second sets of information to provide a cumulative value reflecting a number of instances in which a set of information corresponding with one of the first and second sets of one or more attributes has been received at the accounting system.

15. The method of claim 13, further comprising disposing the multiple document processing facilities in a single apparatus.

16. The method of claim 13, in which the account log comprises a portion of configurable memory, further comprising configuring the configurable memory in response to input from a user to the account log manager.

17. The method of claim 13, in which the account log is switchable between an enabled state and a disabled state so that storage of information sets is permitted in the enabled state and prohibited in the disabled state, further comprising switching the account log from the enabled state to the disabled state.

18. The accounting system of claim 17, in which a job portion is being received by said account log for execution and the account log is in the enabled state, further comprising delaying disabling of the account log until execution of the job portion is completed.

19. The accounting system of claim 13, in which a portion of a job is executed by the document processing system, further comprising providing an indication that the portion of the job has been executed to the account log.

20. The method of claim 13, further comprising multiplying the first and second sets of information one or more billing rates to provide a cost value for representing the cost associated with executing one or more jobs in the document processing system.

* * * * *